US007267164B2

(12) United States Patent
Wanni et al.

(10) Patent No.: US 7,267,164 B2
(45) Date of Patent: Sep. 11, 2007

(54) ANTI-VIBRATION TUBE SUPPORT

(75) Inventors: Amar S. Wanni, Falls Church, VA (US); Thomas M. Rudy, Warrenton, VA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 113 days.

(21) Appl. No.: 11/253,816

(22) Filed: Oct. 20, 2005

(65) Prior Publication Data

US 2006/0070727 A1 Apr. 6, 2006

Related U.S. Application Data

(63) Continuation-in-part of application No. 10/848,903, filed on May 19, 2004, now Pat. No. 7,032,655.

(60) Provisional application No. 60/511,623, filed on Oct. 15, 2003, provisional application No. 60/480,921, filed on Jun. 24, 2003.

(51) Int. Cl.
*F28F 1/00* (2006.01)

(52) U.S. Cl. ..... 165/162; 165/172

(58) Field of Classification Search ..... 165/162, 165/165, 172; 248/68.1; 138/106, 107, 138/112, 115–117
See application file for complete search history.

(56) References Cited

U.S. PATENT DOCUMENTS 2,317,572 A 4/1943 Whitt et al.
3,715,275 A * 2/1973 Krawiec ..... 376/442
3,933,583 A * 1/1976 Jabsen ..... 376/438
4,160,477 A * 7/1979 Roffler ..... 165/172
4,175,003 A 11/1979 Beuchel et al.
4,359,088 A * 11/1982 Jabsen ..... 165/172
4,570,703 A * 2/1986 Ringsmuth et al. ..... 165/162
4,594,216 A 6/1986 Feutrel
4,648,442 A * 3/1987 Williams ..... 165/162
4,781,884 A 11/1988 Anthony
4,860,697 A * 8/1989 Malaval ..... 122/510
4,919,199 A * 4/1990 Hahn ..... 165/162
5,072,786 A * 12/1991 Wachter ..... 165/69
5,213,155 A * 5/1993 Hahn ..... 165/162
5,553,665 A * 9/1996 Gentry ..... 165/162
5,570,739 A * 11/1996 Krawchuk et al. ..... 165/69
6,401,803 B1 * 6/2002 Hahn ..... 165/69

* cited by examiner

*Primary Examiner*—Teresa J. Walberg
(74) *Attorney, Agent, or Firm*—Glenn T. Barrett

(57) ABSTRACT

A tube support device for a plurality of elongated members is disclosed. The support device includes an elongated longitudinally extending strip having a pair of opposing faces. The strip includes a plurality of engaging members extending from the pair of opposing faces. The support device is sized such that the support device is located between adjacent rows of elongated members. The plurality of engaging members arranged such that a portion of the plurality of engaging members extend from one face of the opposing faces and are arranged to contact the elongated members positioned adjacent one face and another portion of the plurality of engaging members extend from another face of the opposing faces and are arranged to contact the elongated members positioned adjacent the other face. The plurality of engaging members are located adjacent one end of the strip and extend along only a portion of the length of the strip. The remaining portion of the strip contains no engaging members.

24 Claims, 9 Drawing Sheets

X–X

Y–Y

ANTI-VIBRATION TUBE SUPPORT

CROSS REFERENCE TO RELATED APPLICATIONS

This application is a continuation-in-part of U.S. patent application Ser. No. 10/848,903 to Wanni et al., entitled "Anti-Vibration Tube Support," which claims priority to U.S. Provisional Patent Application Ser. No. 60/480,921 to Wanni et al., entitled "Anti-Vibration Tube Supports" and U.S. Provisional Patent Application Ser. No. 60/511,623 to Rudy et al., entitled "Anti-Vibration Tube Support", the disclosures of which are incorporated by reference.

FIELD OF THE INVENTION

This invention relates to tube supports devices, commonly referred to as tube stakes. The tube support devices are installed to control flow-induced vibration and prevent movement of the tubes or rods within the bundle. The present invention is useful with tube or rod bundles in heat exchangers, steam generators and similar fluid-handling equipment. It is contemplated that the present invention may be used in any application where vibration caused by fluid flow across a pattern of elongated members (tubes, pipes, rods, etc.) presents a problem.

BACKGROUND OF THE INVENTION

Tube bundle equipment such as shell and tube heat exchangers and similar items of fluid handling devices utilize tubes organized in bundles to conduct the fluids through the equipment. In such tube bundles, there is typically fluid flow both through the insides of the tubes and across the outsides of the tubes. The configuration of the tubes in the bundle is set by the tubesheets into which the tubes are set. One common configuration for the tubes is the rectangular formation with the tubes set in aligned rows with tube lanes (the straight paths between the tubes) between each pair or rows, aligned orthogonally to one another. In this formation, each tube is adjacent to eight other tubes except at the periphery of the tube bundle and is directly opposite a corresponding tube across the tube lane separating its row from the two adjacent rows. In the triangular tube formation, the tubes in alternate rows are aligned with one another so that each tube is adjacent six other tubes (the two adjacent tubes in the same row and four tubes in the two adjacent rows).

Fluid flow patterns around the tubes as well as the changes in the temperature and density of the fluids which arise as they circulate as a result of the heat exchange between the two fluids flowing in and around the tubes may give rise to flow-induced vibrations of an oscillatory nature in the tube bundle. If these vibrations reach certain critical amplitudes, damage to the bundle may result. Tube vibration problems may be exacerbated if heat exchange equipment is retubed with tubes of a different material to the original tubes, for example, if relatively stiff materials are replaced with lighter weight tubes. Flow-induced vibration may also occur when equipment is put to more severe operating demands, for example, when other existing equipment is upgraded and a previously satisfactory heat exchanger, under new conditions, becomes subject to flow-induced vibrations. Vibration may even be encountered under certain conditions when an exchanger is still in the flow stream but without heat transfer taking place.

Besides good equipment design, other measures may be taken to reduce tube vibration. Tube support devices or tube stakes as these support devices are commonly known (and referred to in this specification) may be installed in the tube bundle in order to control flow-induced vibration and to prevent excessive movement of the tubes. A number of tube supports or tube stakes have been proposed and are commercially available. One type, described in U.S. Pat. No. 4,648,442 to Williams has a U-shaped configuration in which the distance between the top and bottom surfaces of the channel is the same as the distance between adjacent rows in the tube bundle (i.e. is substantially the same as the tube lane dimension). This type of stake is inserted between the rows in the bundle and is secured at end by an arcuate segment which engages a segment of a tube at the periphery of the tube bundle so as to lock the stake in place in its appropriate position between the rows in the bundle. Stakes of this type are typically made of a corrosion-resistant metal, for example, type 304 stainless steel with a thickness between 0.7 and 1.2 mm to provide both the necessary rigidity for the staked tube bundle as well as sufficient resilience in the U-shaped channel to allow the stakes to be inserted into the lanes between the tubes in the bundle.

Another form of anti-vibration tube stake is described in U.S. Pat. No. 4,919,199 to Hahn, which discloses a stake made in a soft V-configuration strip in which saddles are formed perpendicular to the longitudinal axis of the strip in the open ends of these V-shaped cross sections. The saddles are formed in the strip with a pitch (distance between saddles) equal to the tube pitch and with a radius which matches that of the tubes in the tube bundle so the saddles engage with the tubes on one side of the tube lane. The engagement between these tubes and the saddles locks the tube into place in the tube bundle. The resilient nature of the strip, coupled with the spring type action provided by the V-configuration permits the arms of the V to open and reduce the effective overall width of the stake enables the stake to engage the tubes on both sides of a tube lane in so that the V-shaped stake is locked into place between the two rows of tubes.

A similar type of tube stake is described in U.S. Pat. No. 5,213,155 to Hahn which discloses a U-shaped stake which is inserted between two tube lanes with the closed end of the U over one of the peripheral tubes in the bundle. Saddles are formed in the open ends of the V-shaped cross section to engage with opposite sides of the tubes in a single row in the bundle. The U-shaped stake is fastened in place around the tubes of the bundle by suitable fasteners extending between the two arms of the stake.

One problem with the pressed configuration of the type shown in U.S. Pat. No. 4,648,442 is that the stakes do not create a positive location for each individual tube, although the stake is locked into place in its selected tube lane. The tubes remain free to vibrate in one plane parallel to the tube lane and parallel to the stake. A different problem exists with the design shown in U.S. Pat. No. 5,213,155: although the tubes in rows encircled by the U-shaped stakes are fully supported, the tubes at the periphery of the tube bundle which are not directly encircled by one of the stakes i.e., retained within one of the closed ends of the U-shaped stakes (these are the outer tubes in alternate rows which are not encircled by the ends of the U-shaped stakes), are free to move and vibration in these tubes can be expected under certain conditions. In addition, because the corrugation of the tube support has a transition region before reaching its full depth the two tubes adjacent to each of the outermost tubes do not receive any vibration mitigation either.

One disadvantage of the stake designs which use channel pressings to accommodate the distance between the tubes forming a single tube lane is that deep channel pressings are required or other measures necessary when the tube lane is relatively wide. A more complicated form of tube support is shown in U.S. Pat. No. 6,401,803 to Hahn. This stake uses two V-shaped pressings separated by compression springs which force the stakes against the tubes on opposite sides of the tube lane in order to dampen oscillatory vibrations. This form of stake is, however, quite expensive to manufacture. A unitary stake which will accommodate relatively wide tube lanes without the complication of separate parts therefore remains desirable.

SUMMARY OF THE INVENTION

According to an aspect of the present invention, a tube support device or tube stake is provided that is useful to mitigate the possibility of tube damage from flow-induced vibration in tube bundles. The tube support device or stake includes an elongated member or strip which is intended to be inserted in a space or spacer lane between the tubes of a tube bundle in a heat exchanger, condenser or other tube bundle device. The support device includes raised-tube-engaging zones are disposed in transverse rows across the strip at successive longitudinal locations along a portion of the length of the strip. The tube-engaging zones extend laterally from opposing faces of the strip to engage with tubes on opposite sides of the tube or spacer lane or space into which the stake is inserted. The tube-engaging zones are preferably arranged so that they extend laterally from the two opposed faces of the strip in an alternating manner, with the tube-engaging zones in each row alternately extending first from one face of the strip and then the other, along the row. This alternating arrangement within each transverse row is preferably used with a second alternating arrangement in which the raised tube-engaging zones alternate from one face of the strip to the other at the same transverse location in successive rows. The raised, tube-engaging zones may suitably be formed as dimples or corrugations to engage the successive pairs of tubes which are opposite one another on a tube lane and located adjacent to one another in a tube row.

It is an aspect of the present invention to provide a support device for a plurality of elongated members. The plurality of elongated members are arranged in rows of elongated members. It is contemplated that the plurality of elongated members can be arranged in various configurations. The elongated members may be tubes or rods arranged in a bundle. The bundle may be located in a heat exchanger. The support device includes an elongated longitudinally extending strip having a pair of opposing faces. The strip has a length. The strip includes a plurality of engaging members extending from the pair of opposing faces. The support device is sized such that the support device is located between adjacent rows of elongated members. The plurality of engaging members arranged such that a portion of the plurality of engaging members extend from one face of the opposing faces and are arranged to contact the elongated members positioned adjacent one face and another portion of the plurality of engaging members extend from another face of the opposing faces and are arranged to contact the elongated members positioned adjacent the other face. The plurality of engaging members are located adjacent one end of the strip and extend along only a portion of the length of the strip. The remaining portion of the strip contains no engaging members.

It is contemplated that the plurality of engaging members are arranged in a plurality of transverse rows. Each transverse row may contain at least one engaging member extending from the one face and at least one engaging member extending from the other face. The plurality of engaging members may be formed as dimples or corrugations in the strip.

At least one end of the strip may include an engagement assembly. The engagement assembly is adapted to a fastening assembly to secure the tube support device to the plurality of elongated members. The engagement assembly is also adapted to engage with an orienting device such that the strip can be located between adjacent rows of elongated members.

The support device or stakes may be used in both conventional tube formations, either the rectangular formation or the triangular tube formation. The support devices may be inserted between rows of adjacent elongated members or tubes in a space or spacer lane or tube lane formed between the tubes. The stakes or support device may be inserted in all spacer lanes or into alternate spacer lanes. When inserted into each spacer lane, the elongated members receive support from stakes on both sides. Because the effective gap between the tubes (tube lane dimension) is smaller with the triangular formation the thickness as well as the height of the raised tube-engaging zones will normally be smaller in order for the stake to be inserted between the tube lanes with this configuration. It is further contemplated that the support devices may be used in arrangements where a row between adjacent elongated members is not clearly defined.

The support devices of the present invention may be conveniently and inexpensively fabricated by pressing with dies equipped with suitably arranged protrusions and cavities to form the dimples, corrugations or other forms of tube-engaging zones or by the use of pairs of rollers which have protrusions and cavities (alternating between the top and bottom rollers of the set) to form the raised zones on the strip. The support devices may be formed by cold rolling. Many of the known types of tube stake do not lend themselves to this economical and convenient method of fabrication.

BRIEF DESCRIPTION OF THE DRAWINGS

The invention will now be described in connection with the following drawing in which like reference numerals designate like elements and wherein.

DETAILED DESCRIPTION OF PREFERRED EMBODIMENTS

The support device or stake of the present invention is arranged to provide direct support for elongated members such as tubes, rods, pipes or the like that are adjacent to one another but separated by a space. The elongated members may be separated by a defined tube or spacer lane or a less defined space. The less defined space may occur when the support device is retrofit into an existing bundle of tubes where warping or deformation of the tubes or rods may have occurred as a result of prolonged use. While the present invention is described in connection with tubes or tube bundles, it is not intended that the present invention be used solely with cylindrical, hollow tubes. It is intended that the present invention may be used in with hollow or solid rods or tubes. Furthermore, the tubes are not limited to a circular cross section; rather, it is intended that the tubes or rods may be square, triangular or have any other suitable configuration. The overall length of the tube support device may vary based on the size of the bundle and how well the space or spacer lane between adjacent elongated members or tubes is defined. The tube support may have a sufficient length such that it extends from one side of a bundle to the other side. In many cases, however, the location of pass lanes in the bundle will create discontinuities in the lanes so that it will not be possible to insert the stakes all the way across the bundle. In such cases, the tube support may have a shorter length, as disclosed for example in the embodiments illustrated in FIGS. 8-11 when the space between the tubes or rods is not clearly defined. With such an arrangement, it may be possible to insert the stakes into the bundle from different angles along the length of the bundle in order to provide as much support as possible for the tubes. Thus, the stakes will be inserted transversely into the bundle at each axial location in an angularly variant direction (at a different angle in the transverse plane of the tubes) from the direction of insertion at the next axially adjacent location. This may, however, leave the tubes without staked support in some parts of the bundle, normally in the middle of the bundle where access from the periphery is precluded. In view of their simple and repetitive configuration, the present tube stakes may be readily cut to the desired length to fit the bundle, whether extending entirely across it or only part of the way.

Figure 1A:
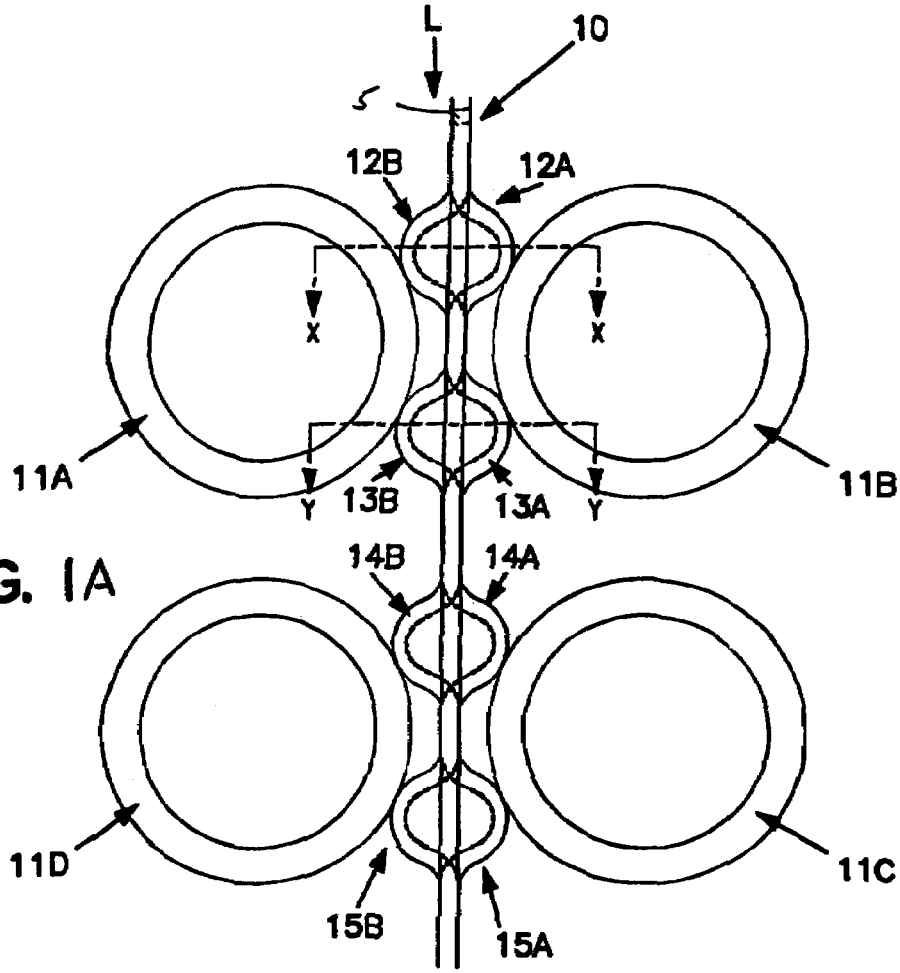
FIG. 1A is a cross-section of four tubes in a rectangular arrangement heat exchanger with a tube support device according to an embodiment of the present invention supporting the elongated members.
Figure 1B:
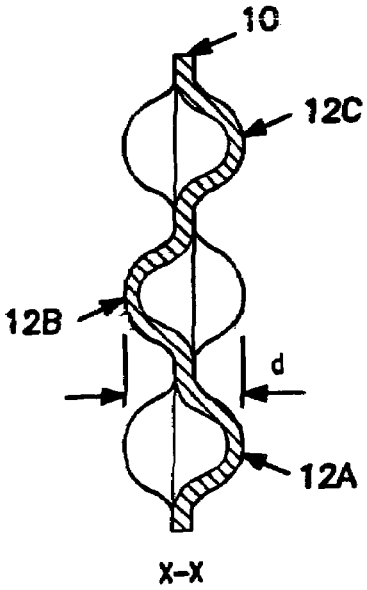
FIG. 1B is a sectional view of the tube engaging members along line X-X of FIG. 1A.
Figure 1C:
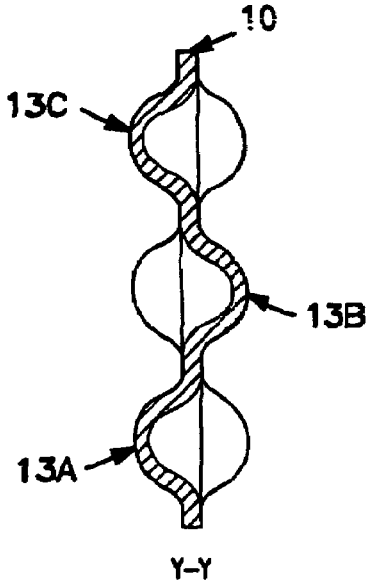
FIG. 1C is a sectional view of the tube engaging members along line Y-Y of FIG. 1A.

FIG. 1A shows four adjacent tubes in a bundle with a rectangular tube formation. For illustrative purposes, only four tubes are shown. In practice, each bundle includes a plurality of rows of tubes such that a plurality of spacer lanes are present. A tube support device or tube stake according to the present invention is inserted into the tube lane between two rows of tubes. Each tube support device or stake 10 is formed from a strip of metal. The tube stakes are suitably made of a metal which will resist corrosion in the environment of the tube bundle device in which it is to be used. Normally, to resist corrosion, stainless steel will be satisfactory. The support device 10 extends in spacer lane or tube lane L defined by tubes 11A and 11D on one side of the lane and tubes 11B and 11C on the other side of the lane. Tube support device 10 includes elongated or tube engaging members in the form of raised dimples arranged in transverse rows 12, 13, 14, 15 of three dimples across the strip. While four rows of dimples are shown, it is contemplated that more than four rows may be provided. It is also contemplated that less than four rows may be provided. The transverse rows are arranged at successive longitudinal locations along the length of the strip. The rows may extend along the entire length of the strip or along only a portion of the strip, as shown for example in the embodiment of FIG. 8. Each pair of successive rows is positioned to provide support for a pair of tubes which are adjacent one another and on opposite sides of the tube lane. Thus, the dimples in rows 12 and 13 provide support for tubes 11A and 11B, the dimples in rows 14 and 15 provide support for the tubes in rows 11D and 11C. In a similar manner, successive opposite pairs of tubes along the same tube lane are supported by successive pairs of transverse rows of dimples.

Each row of tube engaging members includes a plurality of dimples. At least one dimple extends from each side of the strip. The dimples are arranged such that adjacent dimples are positioned on opposing sides of the strip, as shown in FIGS. 1B, 1C, 2B, 2C, 4, 7, 9 and 10. Similarly, adjacent dimples in adjacent transverse rows are arranged on opposing sides of the strip. While such an arrangement is preferred, it is also contemplated that adjacent dimples may extend from the same side of the strip so long as each row includes at least one dimple extending from each side of the strip. The embodiment shown in FIGS. 1A, 1B and 1C includes three tube engaging members or projections in each transverse row. Such an arrangement is appropriate for a tube stake with a width of approximately 4-6 cm, convenient for many applications. The present invention is not limited to rows having only three tube engaging members; rather, it is contemplated that more than three engaging members may be provided in each row. This arrangement is appropriate for wide strips. It is also contemplated that less than three engaging members may be provided in each row.

The number of dimples may be varied according to the width of the strip and the depth (or height) of the dimples. The total depth (d) of the dimples (peak to valley, including plate thickness) will naturally be related to the separation between the tubes which are to be engaged by the tube-engaging zones of the strip, i.e. to the dimension of the tube lane. It will also vary according to the diameter of the tubes because this will affect the level (relative to the tube) at which engagement will occur when the stake is in place in the bundle. Typically, the total depth of the tube-engaging zones, d, will be from 0.5 to 2 mm, preferably 0.5 to 1.5 mm (for typical heat exchangers having 25.4 mm tubes arranged on a 32 mm pitch) greater than the spacing between the tubes at the point where tube engagement occurs so that a tube deflection of similar magnitude is achieved at this point. The exact combined deflection (of the two tubes on either side of the support device) achieved in practice will be less than the difference between "d" and the tube spacing because the dimples fit around the tube but this stake depth will normally be found suitable to give a tube deflection which provides good support and vibration resistance and results in a very rigid bundle. The elasticity of the stake itself and the elasticity of the tubes, coupled with engagement between the raised tube-engaging zones and the tubes will not only make the tubes more resistant to vibration but also retain the stake in place in the bundle. Desirably, the total depth of the tube-engaging zones (the tip-to-valley distance d including strip thickness) is selected so that each stake deflects the tube from its rest position with a minor tube deflection, typically about 0.5 to 2 mm. This is a feature of the present type of stake which permits the use of a smaller number of stakes than has been customary, typically, about 50% fewer than would otherwise be needed. One advantage of the present type of tube stake is that relatively wide tube lanes can be accommodated without deep pressing of the strips since about half the tube lane dimension is taken up by each raised zone. In addition to the total depth of the stake, the thickness and stiffness of the metal of the strip will be factors in fixing the final tube deflection when the stakes are inserted into the bundle. Normally, a strip thickness of from 1 to 2 mm will be satisfactory to provide adequate tube support and ability to resist the stresses of insertion into the bundle.

Figure 6:
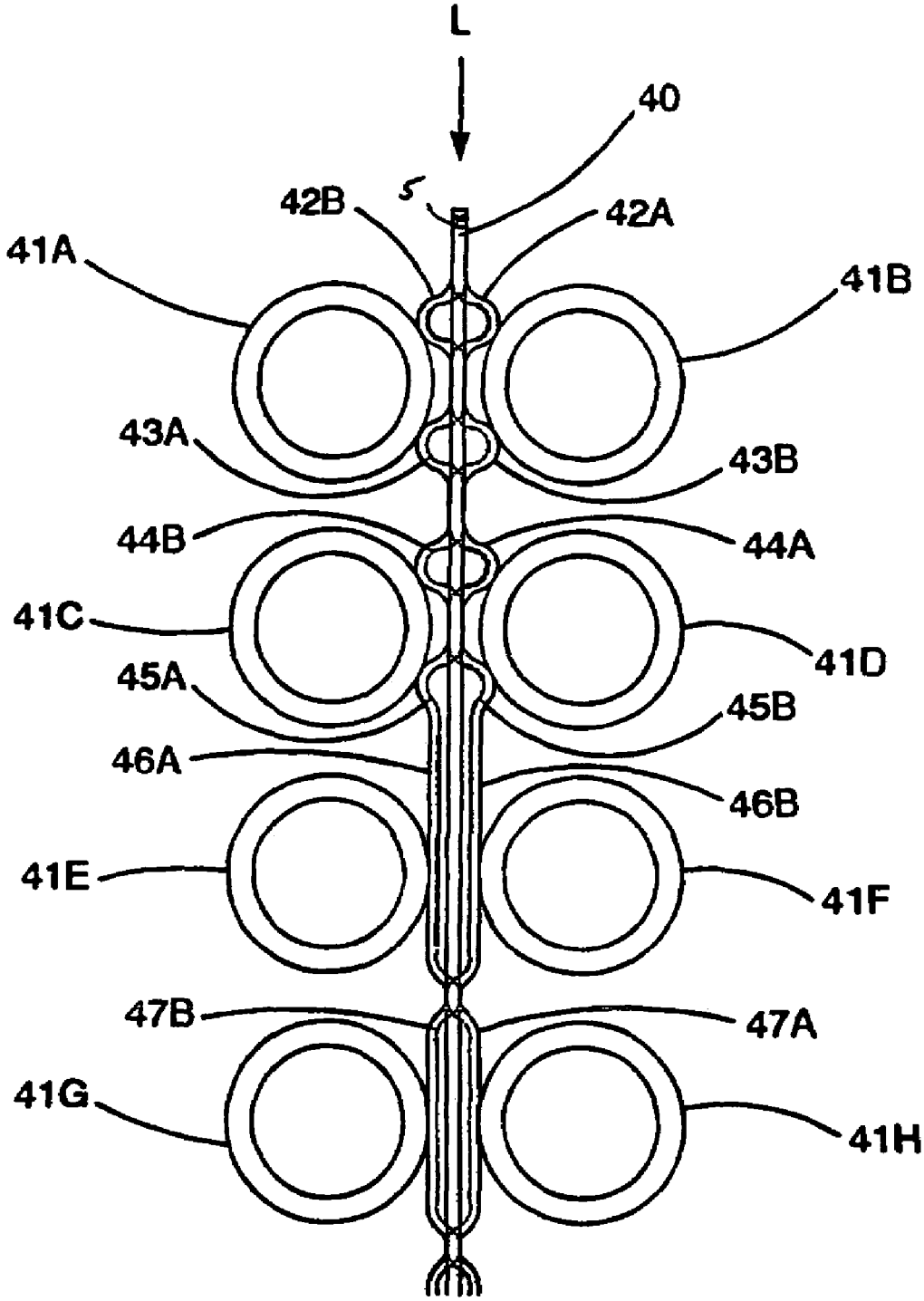
FIG. 6 is a cross-section of eight tubes in a rectangular arrangement heat exchanger with a tube stake with alternating engagement members on each side of the stake with dimples at the outer end of the stake and corrugations in its inner portion supporting the tubes.
Figure 7:
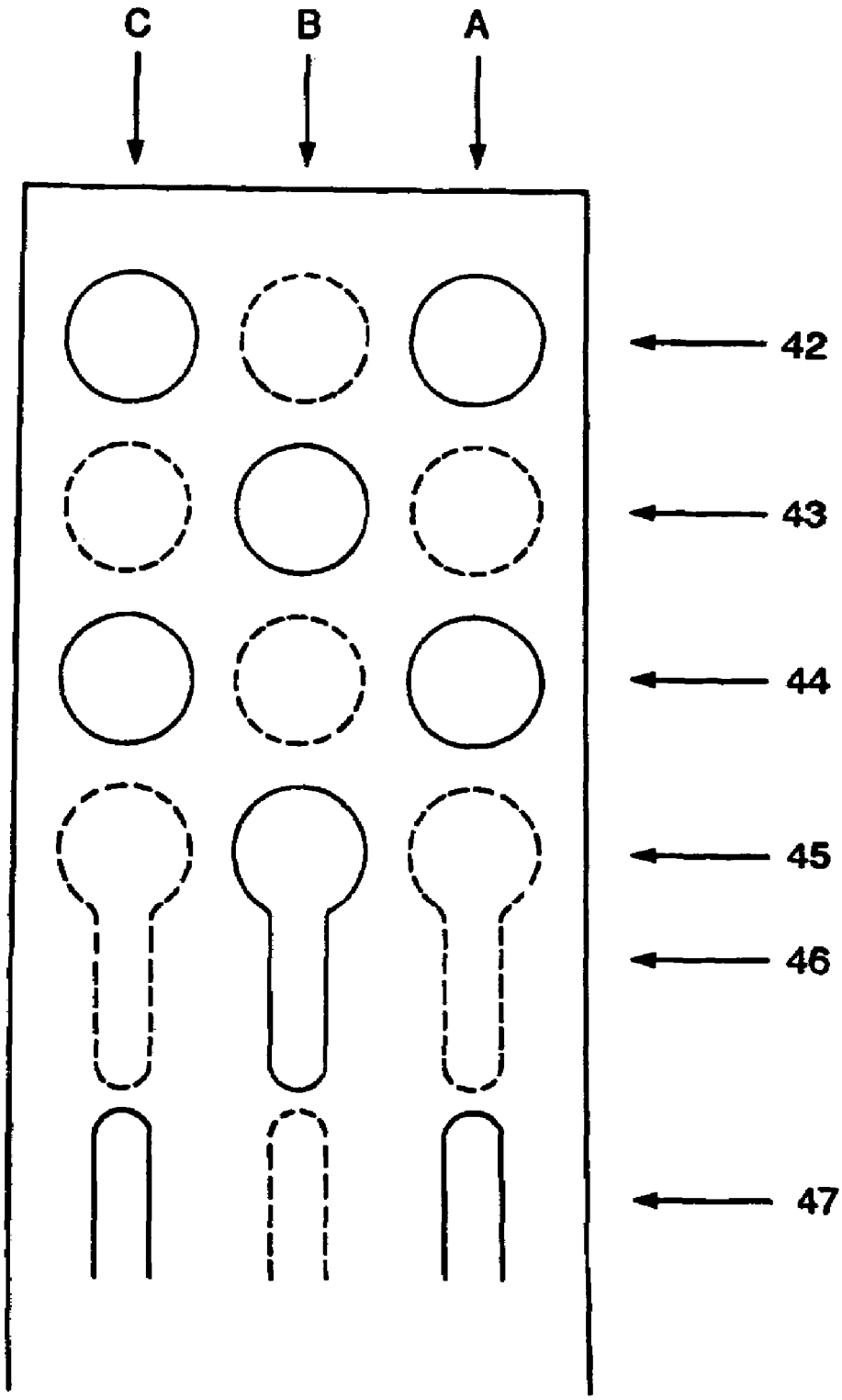
FIG. 7 shows a face view of the tube stake of FIG. 6.

The tube engaging members are not intended to be limited to dimples. Other configurations includes longitudinally extending corrugations, as shown in FIGS. 3A, 3B, 3C, 3D, 5 and 11 are considered to be within the scope of the present invention. Furthermore, each tube engaging member may be formed from a combination of dimples and corrugations, as shown in FIGS. 6 and 7. Other configurations are possible as long as the essential functional objective of engaging with the tubes is retained. Tube-engaging zones in the form of circular dimples are easy to fabricate but dimples of other shapes may also be used, for example, dimples with a triangular, rectangular, square or other polygonal form or with an elliptical or an oval (race-course) shape. The tube-engaging zones could also be in the form of transversely-extensive corrugations on a strip of suitable width to accommodate the corrugations.

Figure 2A:
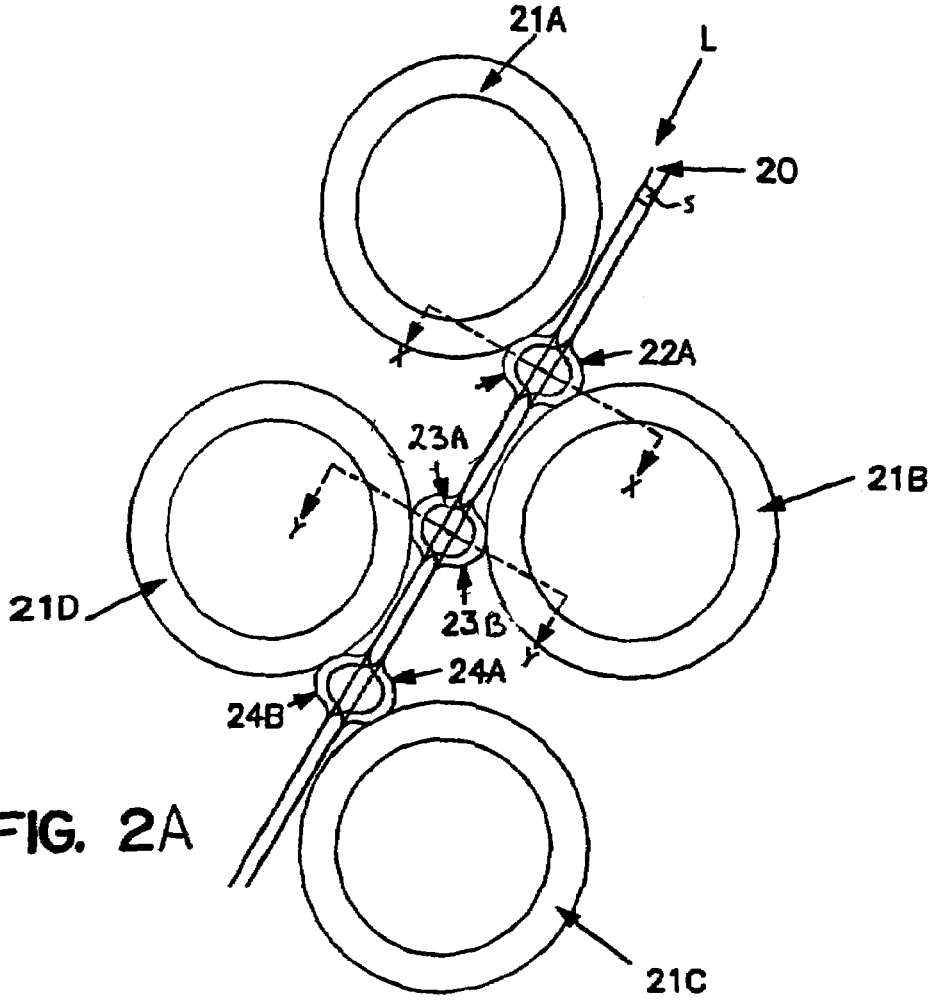
FIG. 2A shows a tube support device with alternating raised engagement members on each side of the stake for supporting the tubes in a heat exchanger with a triangular tube configuration.
Figure 2B:
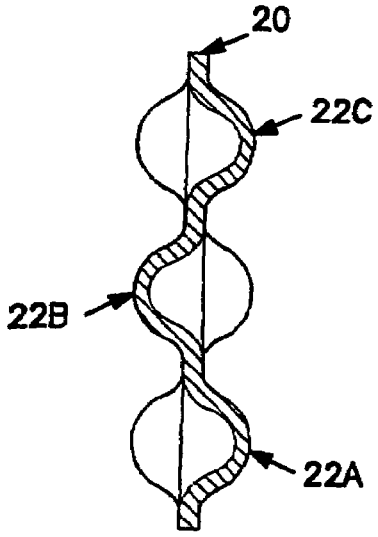
FIG. 2B is a sectional view of the tube engaging members along section line X-X of FIG. 2A.
Figure 2C:
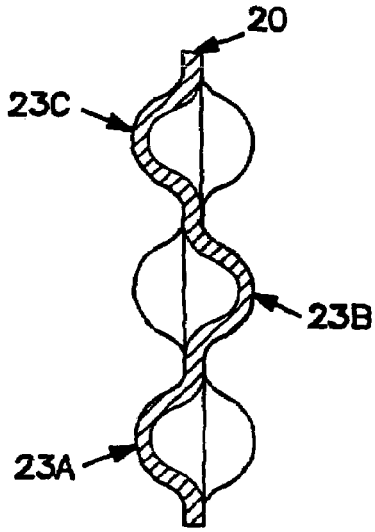
FIG. 2C is a sectional view of the tube engaging members along section line Y-Y of FIG. 2A.

FIG. 1A shows the tube support device positioned within a spacer lane in a bundle having a rectangular tube formation. Stakes may also be employed with triangular tube formations, as shown in FIG. 2A. In FIG. 2A, the tube support device 20 runs in the spacer lane between tubes 21A and 21D on one side of tube lane L, and tubes 21B and 21C on the other side of the tube lane. A first transverse row 22 of raised, tube engaging members is provided by dimples 22A and 22C extending out from one face of the strip to engage tube 21B and by a single dimple 22B on the opposite face of the strip engaging tube 21A. In the next transverse row 23 the dimples are arranged alternately with respect to the dimples at the same transverse location in row 22 so that tube 21B is engaged by the single dimple 23B and tube 21D is engaged by the opposite face of the strip to dimples 23A and 23C.

Figure 8:
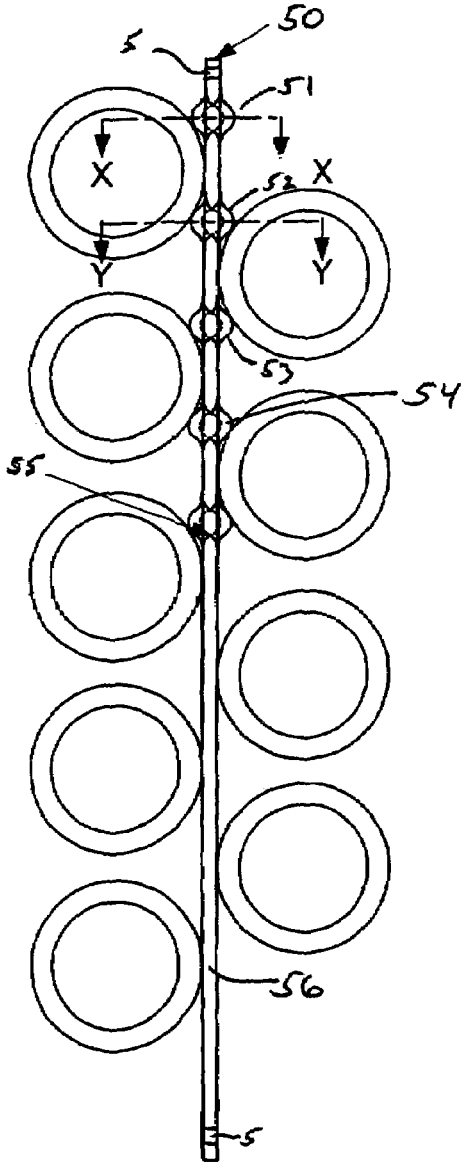
FIG. 8 is a cross-sectional view of a tube support device according to a preferred embodiment of the present invention.
Figure 11:
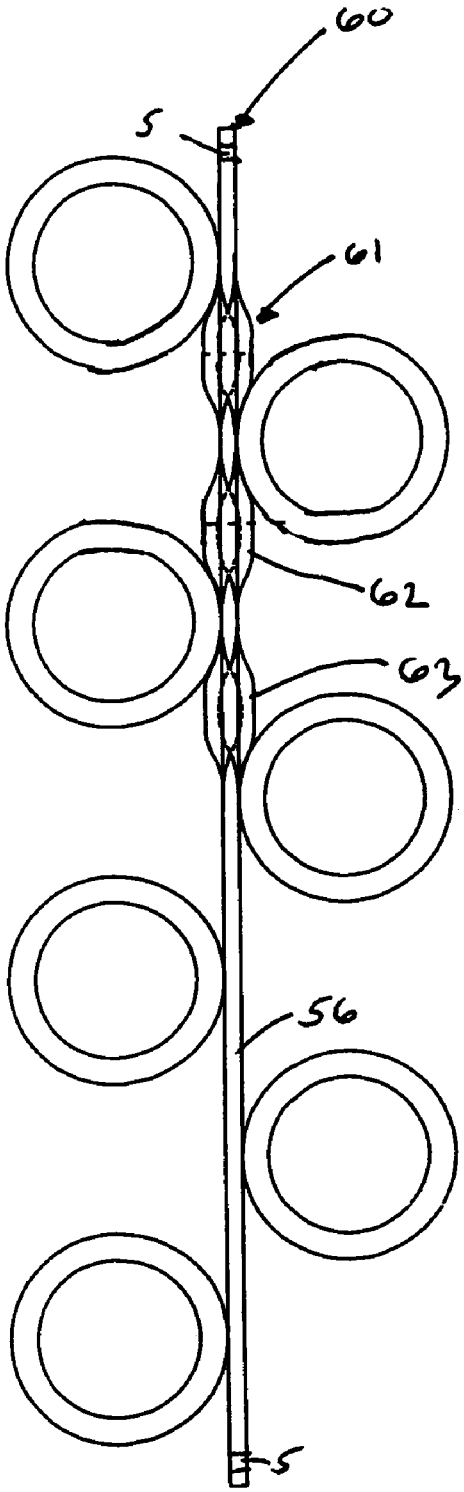
FIG. 11 is a cross-sectional view of a tube support device according to another embodiment of the present invention.

In case of the triangular tube formation, the tubes on opposite sides of a tube lane are both supported by the tube stake, receiving their support from the tube-engaging zones extending out from both faces of the strip but, in this case, the support is given in a staggered, alternating manner which matches the staggered, alternating tube formation. Thus, the first pair of transverse rows (22, 23) supports tube 21B on one side of tube lane L but one adjacent tube, 21A, on the opposite side of the tube lane receives support from this pair of rows; its support is also received from a row (not shown) of the next successive row pair. Similarly, tube 21D is supported by the tube-engaging zones in row pair 23, 24 but these two rows support two tubes, 21B and 21C on the opposite side of the tube lane. Because the effective gap between the tubes (tube lane dimension) in the triangular tube formation is smaller than that of the rectangular formation, the plate thickness as well as the total depth of the dimples (peak to valley, including plate thickness) will typically be smaller than that for the rectangular arrangement. It is also contemplated that the tube engaging members may be formed on only the outer portion of the strip, as shown in FIGS. 8 and 11. The thickness of the strip without dimples may be sufficient to reduce vibration. In the same way as described above, the tube support device may be inserted into the tube lane between the tubes and pushed into place until engagement with the tubes on both sides of the tube lane. Retention between the tube stake and the tubes is maintained by the elasticity of the metal and by the tube-engaging zones on the stake.

Figure 3A:
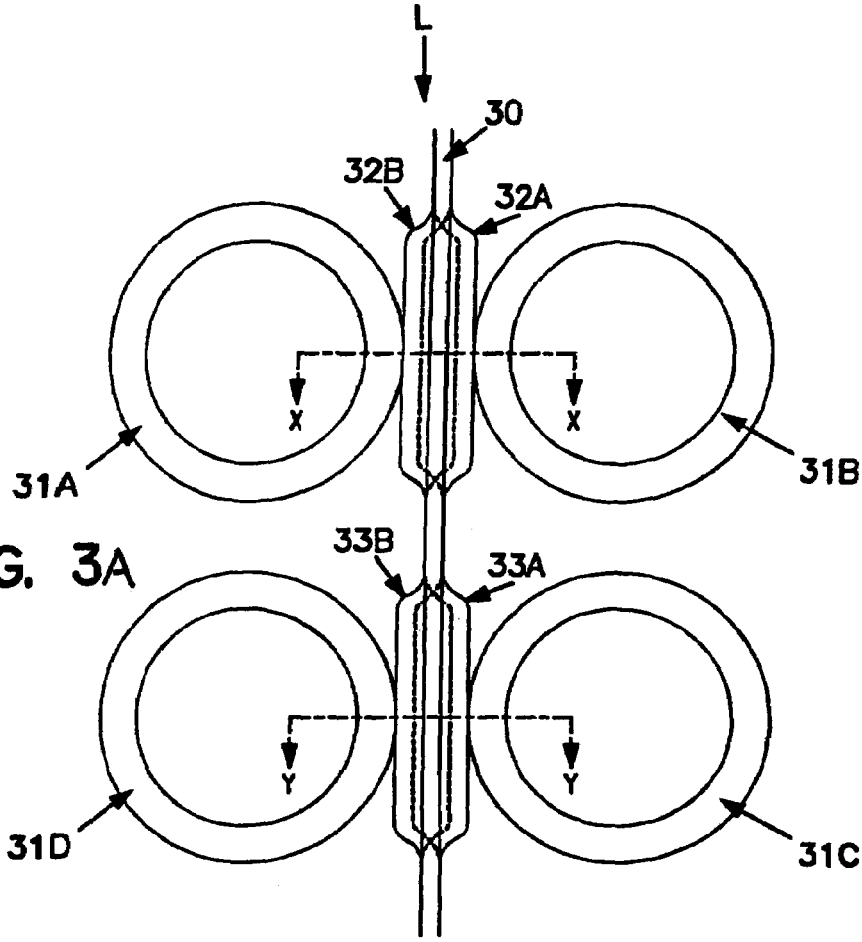
FIG. 3A is a cross-section of four tubes in the bundle of a rectangular arrangement configuration with a tube support device having alternating longitudinal corrugations on each side of the stake.
Figure 3B:
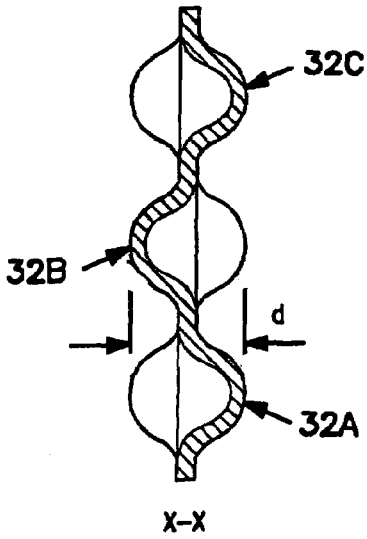
FIG. 3B is a sectional view of the tube engaging members along line X-X of FIG. 3A.
Figure 3C:
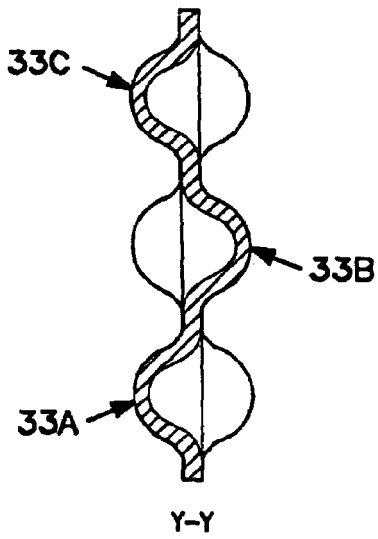
FIG. 3C is a sectional view of the tube engaging members along line Y-Y of FIG. 3A.

As discussed above, it is not essential for the tube-engaging members to be in the form of dimples which engage a segment of each tube at two points. As shown in FIGS. 3A and 11, the raised tube-engaging zones may be provided in the form of corrugations which extend longitudinally, parallel to the longitudinal axis of the tube stake to engage the tubes at one point around the circumference of the tubes. In FIG. 3A, tube stake 30 is inserted into the tube lane L between tubes 31A and 31D on one side of the tube lane and tubes 31B and 31C on the other side of the lane. Tube stake 30 is provided with longitudinal corrugations arranged in successive transverse rows 32, 33 which continue along the length of the tube stake, spaced apart according to the spacing distance between the tubes in the bundle. The corrugations are arranged in a similar manner to the dimples described above, with corrugations in transverse rows forming the raised, tube-engaging members, engagement taking place between adjacent tubes on opposite sides of the tube lane and each row of corrugations. Corrugations extend on both sides of the medial plane of tube stake 30, with corrugations 32A and 32C extending out to engage tube 31B and single corrugation 32B extending out on the other side of the medial plane of tube stake 30 to engage tube 31A. In the next transverse row of longitudinal corrugations, the corrugations are arranged alternately to those of row 32 (with respect to corrugations at the same transverse location in the row), with corrugations 33A and 33C extending out on one side to engage tube 31D and single corrugation 33B extending out from the opposite face of the strip to engage tube 31C.

Figure 3D:
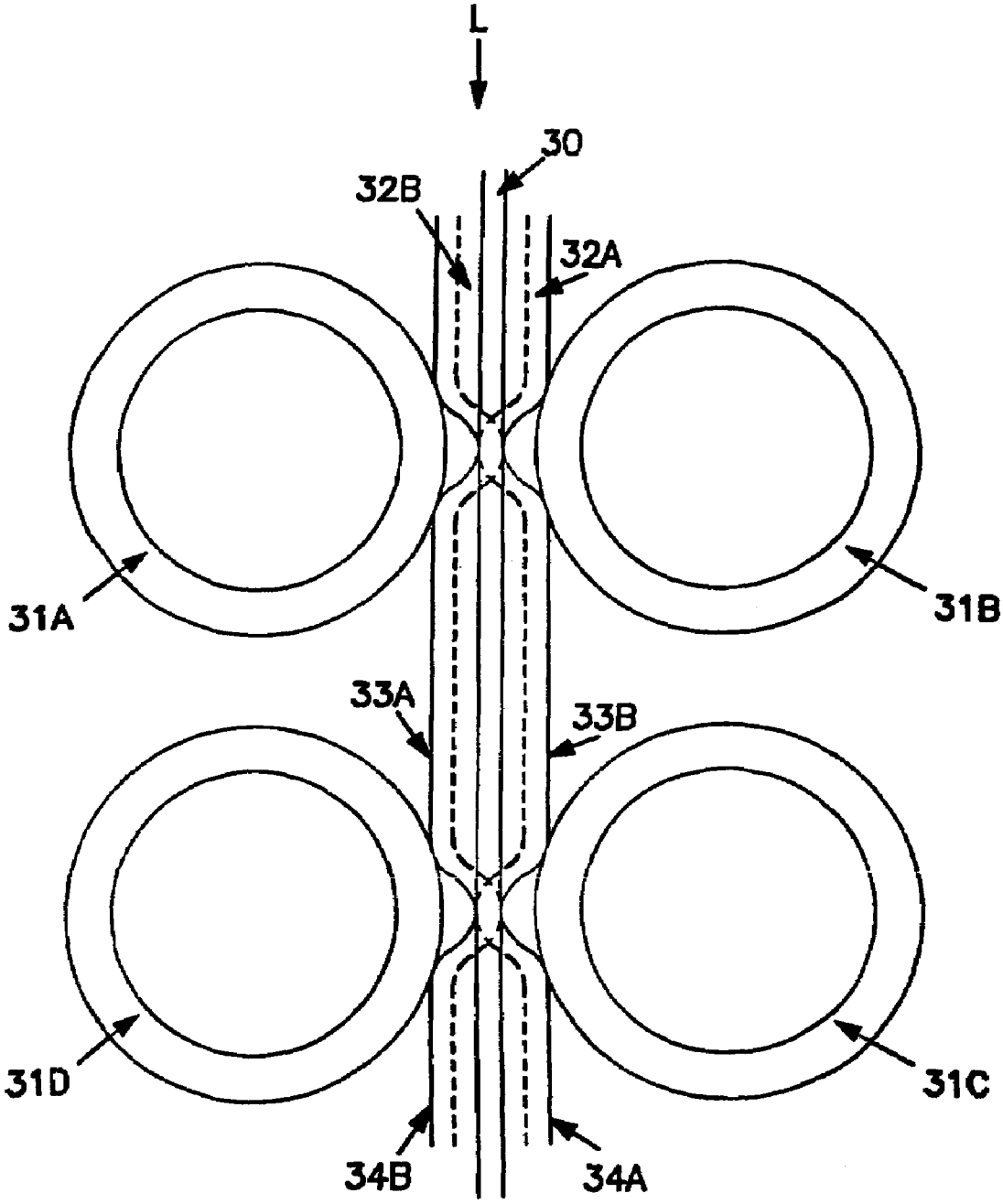
FIG. 3D shows the tube support device of FIG. 3A located in a different position with respect to the tubes in the bundle.
Figure 4:
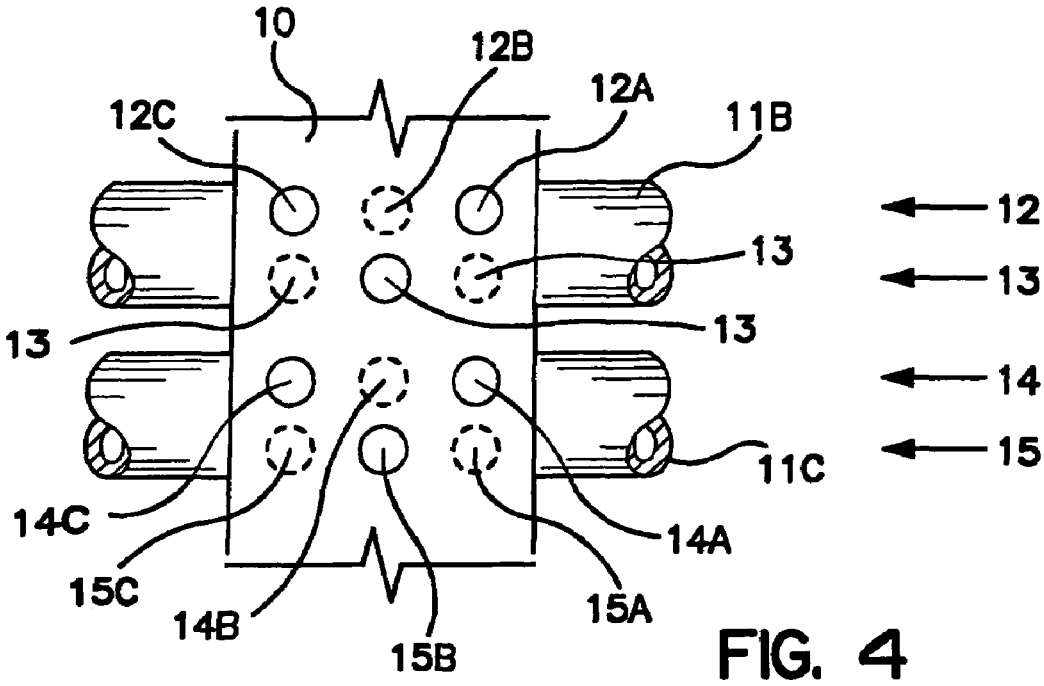
FIG. 4 is a view of the tube stake of FIG. 1A showing the alternating arrangement of engagement members.
Figure 5:
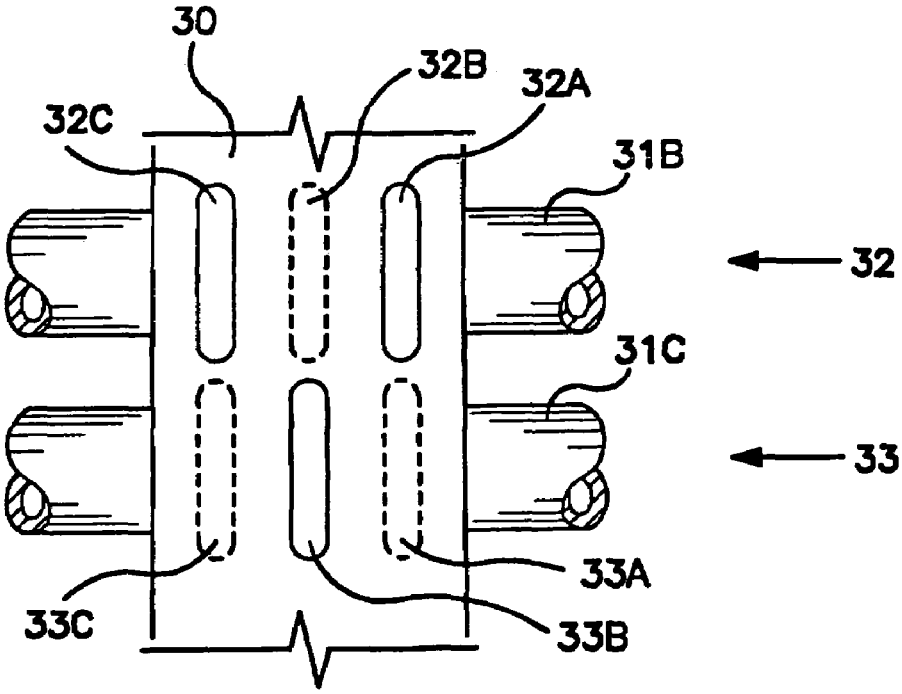
FIG. 5 is a view of the tube stake of FIG. 4 showing the alternating arrangement of engagement members.

When the tube support device or stake is inserted into the spacer lane as shown in FIG. 3A, there will be less positive locking engagement between the corrugations and the tubes than with the dimpled configurations of FIGS. 1A and 2A where the dimples engage with the tubes at two points around the circumference of the tubes to provide positive locking onto the surface of the tubes at two points of arc but the corrugated version has the advantage of being useful with a wider range of tube separations. The total depth (d) of the corrugations (peak to valley, including plate thickness), will normally be about 0.5 to 1.5 mm greater than the spacing between the tubes (i.e., the spacing between adjacent tubes on opposite sides of the tube lane into which the stake is inserted), in order to provide the desired support for the tubes and to retain the stake in place between the tubes. If, however, the stakes are to be inserted into each tube lane so that the tubes are supported on each side by a stake, the total depth, d, of the stake may be made equal to the tube lane dimension. In general terms, therefore, the total depth of the stake will be from 0 to 2 mm greater than the separation between the tubes. The corrugated tube support device may, however, be dimensioned, both in terms of corrugation length and total depth so that it may be inserted into the tube lane as shown in FIG. 3D, with each pair of successive transverse rows engaging with a pair of adjacent tubes on opposite sides of the tube lane., i.e. each corrugation engages two adjacent tubes on the same side of the tube lane with the tubes on each side of the lane nested between the corrugations in each pair of transverse rows.

FIG. 6 shows eight adjacent tubes in a bundle with a rectangular tube formation. A tube support device or tube stake 40 according to the present invention is inserted into the tube lane L between two rows of tubes. Tube support device 40 is formed from a strip which extends in tube lane L defined by tubes 41A, 41C, 41E and 41G on one side of the lane and tubes 41B, 41D, 41F and 41H on the other side of the tube lane. Tube stake 40 has at least four transverse rows 42, 43, 44, 45 of raised tube-engaging members in the form of raised, generally circular dimples extending across the strip, with row 45 merging into the first row of corrugations 46 so that the merged dimples/corrugations form a keyhole-shaped tube-engaging zone which has a quasi-circular dimple 45A, 45B, 45C at the end of the stake and a linear corrugation 46A, 46B, 46C at the inner end. FIG. 7 shows the arrangement of the dimples in longitudinal lines designated A, B and C and in transverse rows designated 42, 43 and 44 so that the dimples may be designated by row and line as 42A, 42B, 42C and so on in each of rows 42, 43 and 44 and the corrugations 46A, 46B, 46C and so on in each of rows 46, 47 and successively further along the length of the support device.

Figure 9:
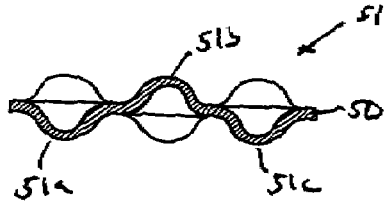
FIG. 9 is a is a sectional view of the tube engaging members along line X-X of FIG. 8.
Figure 10:
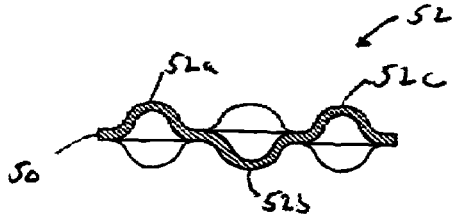
FIG. 10 is a sectional view of the tube engaging members along line Y-Y of FIG. 8.

Another embodiment of the present invention is illustrated in FIGS. 8-11. In FIG. 8, a tube support device 50 is illustrated. As discussed above in connection with the other embodiments, the tube support device 50 is formed from an elongated strip preferably formed from a metal. It is contemplated that other materials may be employed provided the materials are capable of withstanding the temperatures and other physical conditions present that the array of elongated members is exposed to. As shown in FIG. 8, the support device 50 includes a plurality of transverse rows 51, 52, 53, 54, 55 of tube engaging members. Each row includes a plurality of dimples. For example, each row may contain three dimples. In FIG. 9, two dimples 51*a* and 51*c* are positioned on one side of the strip and a single dimple 51*b* is positioned on an opposing side of the strip 50. In FIG. 10, two dimples 52*a* and 52*c* are positioned on one side of the strip and a single dimple 52*b* is positioned on the opposing side of the strip 50. As discussed above, the dimples are arranged such that adjacent dimples in the same row and adjacent rows are located on opposite sides of the strip. While this is a preferred arrangement, the present invention is not intended to be limited to rows having three tube engaging members. Additional tube engaging members may be provided. It is also contemplated that fewer tube engaging members may be provided. Furthermore, it is also contemplated that adjacent tube engaging members may be located on the same side of the strip. Such an arrangement is acceptable so long as each row contains at least one tube engaging member on each side of the strip. The present embodiment is not limited to the use of dimples; rather, other configurations of the tube engaging member are contemplated including rows of corrugations 61, 62 and 63 on the strip 60, shown in FIG. 11.

In the embodiments illustrated in FIGS. 8-11, the rows of tube engaging members extend only partially along the length of the strip 50. The rows are preferably located adjacent one end of the strip 50. The strip 50 includes portion 56 that contains no tube engaging members. The strip 50 has sufficient thickness to provide adequate stiffening of the tubes to reduce vibration. The strips illustrated in the embodiments of FIGS. 8-11 preferably have a thickness of between 1 mm to 4 mm. Such a thickness is suitable for use in heat exchangers having tube diameters of 19 mm to 25 mm, and a standard 1.25 tube pitch to diameter ratio, but larger tube pitches could be accommodated by deeper dimples, corrugations, or thicker strips or by stacking multiple strips together. It is contemplated that the thickness of the strip may be varied for tube diameters that are less than 19 mm or greater than 22 mm. It is contemplated that the thickness of the strip at portion 56 is sufficient to provide some deflection of the adjacent tubes. This deflection of the tubes is sufficient to eliminate vibration and reduce chatter.

The embodiments illustrated in FIGS. 8-11 are well suited for use in tube bundles having 30 degree and 60 degree tube layouts. While a narrow spacer lane may exist between the rows of tubes, the thickness of the strip 50 or 60 is sufficient to engage the tubes to stabilize the tubes and reduce vibration. The outer tubes of the bundle may be sufficiently manipulated using a spacer bar such that the tube engaging members on the outer portion of the strip 50 or 60 engage the outer tubes of the bundle to stabilize the tubes and reduce vibration. It is contemplated that a spacer bar (not shown) may be inserted between the rows of tubes to temporarily increase the size of the spacing between the tubes such that the support device can be properly inserted and oriented. Once the tube support is in place, the spacer bar can be removed.

The embodiments illustrated in FIGS. 8-11 are also well suited for use in tube bundles having 45 degree and 90 degree tube layouts. While a spacer lane may not be clearly defined in the arrangement shown in FIG. 11 for a 45 degree layout, sufficient space is present such that the portion 56 may be forced between the tubes to support the tubes and prevent vibration. This same situation may arise in other tube layouts (e.g., 30, 60, and 90 degrees) where the elongated members may have experienced permanent warpage. If sufficient space is not present, a spacer bar may be used to create a space for insertion of the strip 50 or 60.

When the tube support devices according to the various embodiments of the present invention are inserted into the bundle, the raised tube-engaging members have to be pushed past the tubes or rods until the support device is in its proper place in the bundle. With the dimpled type of tube stake, each row of dimples has to be pushed through the gap between each pair of facing tubes until the stake is in place. Because the total depth of the tube engaging members (peak-to-valley including plate thickness) is preferably greater than the inter-tube spacing, the tubes have to bend slightly to let the dimples pass; although this maintains the stake in place when it is in its final position, it makes insertion that much more difficult as the resistance to bending of each row of tubes has to be overcome. A spacer bar may be inserted between the rows of tubes to temporarily increase the size of the spacing between the tubes such that the support device can be properly inserted and oriented. Once in place, the spacer bar can be removed. The variation in which raised corrugations are used is better in this respect, making insertion easier but at the expense of not having such multi-point retention once the stake is in place.

As can be seen from the drawings, each tube support device engages with tubes or rods on opposite sides of a tube lane so that insertion of a stake in a tube lane provides support for two rows of tubes within the outer periphery of the bundle. At the periphery of the bundle some tubes may receive support from a stake which does not support a tube on the other side. This reduces the effective support given to those tubes but since the length of stake extending out from the last pair of tubes within the bundle is relatively short, some effective support is given to these outer tubes on one side at least by the cantilevered end of the stake. Additional support is provided by the metal band or cable described below.

While the frictional engagement between the stakes and the tubes will provide for retention of the stakes in the bundle, the end of the tube stake may be provided with a tube-engaging crook, to hook over the end of a tube on one side of the tube lane to prevent withdrawal of the stake in one direction. Alternatively, the stakes may be folded into a U-shaped or hairpin configuration which has, effectively, a pair of the stakes conjoined at one end by means of an arcuate, tube-engaging segment. This configuration provides stiffening for three tube rows simultaneously with additional positive location for the stake from the closed end of the hairpin (the arcuate segment) being locked over of the peripheral tubes at one end to the bundle. Because each stake provides stiffening for three tube rows simultaneously, the U-shaped tube stakes will be inserted over alternate rows to provide stiffening for each row of tubes in the bundle. If desired, additional stake retention may be provided by retention members such as bolts extending between the arms of the hairpin at one or more points along its length. Additional locking for tube support devices (not formed into the U-configuration) may be provided using a small hole 5 in the end of the strip through which a metal band or cable can be passed. This metal band would be secured, for example, to tie rods that are available in the bundle device adjacent to the outer tube circumference of the bundle, to reduce the possibility of tube supports sliding down the tubes. The hole 5 can also be used to temporarily secure an assembly thereto to guide or maneuver the strip during the installation process.

Insertion of the tube support devices into the bundle is facilitated by first inserting a spacer bar with beveled edges having a thickness that is slightly greater than the total depth of the stake (including the dimples or other raised zones) after which the stake is inserted into place and the metal bar is slowly removed to ensure the proper locking in of the tubes and the tube stake. The bar may also be used in a similar manner to facilitate removal of the stakes. The stakes may be inserted at axial locations determined by experience or by vibration studies for the relevant equipment. The stakes may be inserted into the bundle in different transverse directions at different axial locations, for example in a vertical direction at the first axial location, in the horizontal at the second location, followed in alternate sequential manner at successive axial locations along the length of the bundle.

It will be apparent to those skilled in the art that various modifications and/or variations may be made without departing from the scope of the present invention. Thus, it is intended that the present invention covers the modifications and variations of the tube support device described herein, provided they come within the scope of the appended claims and their equivalents.

What is claimed is:

1. A support device for a plurality of elongated members, wherein the plurality of elongated members are arranged in rows of elongated members, the support device comprising:

an elongated longitudinally extending strip having a pair of opposing faces, wherein the strip having a length; and a plurality of engaging members extending from the pair of opposing faces, wherein the support device is sized such that the support device is located between adjacent rows of elongated members, wherein a portion of the plurality of engaging members extend from one face of the opposing faces and are arranged to contact the elongated members positioned adjacent the one face and another portion of the plurality of engaging members extend from another face of the opposing faces and are arranged to contact the elongated members positioned adjacent the other face, wherein the plurality of engaging members are located adjacent one end of the strip and extend along only a portion of the length of the strip.

2. The support device according to claim 1, wherein the plurality of engaging members are arranged in a plurality of transverse rows.

3. The support device according to claim 2, wherein each transverse row contains at least one engaging member extending from the one face and at least one engaging member extending from the other face.

4. The support device according to claim 3, wherein the plurality of engaging members are formed as dimples in the strip.

5. The support device according to claim 3, wherein the plurality of engaging members are formed as corrugations in the strip.

6. The support device according to claim 5, wherein each corrugation extends in the longitudinal direction of the strip.

7. The support device according to claim 1, further comprising an engagement assembly on at least one end of the strip adapted to engage with a fastening assembly to secure the tube support device to the plurality of elongated members.

8. The support device according to claim 1, further comprising an engagement assembly on at least one end of the strip adapted to engage with an orienting device such that the strip can be located between adjacent rows of elongated members.

9. The support device according to claim 1, wherein the support device is sized such that adjacent elongated members deflect away from each other.

10. A tube support device for a tube bundle having a plurality of elongated tubes, wherein the plurality of elongated tubes are arranged in rows of elongated members, the tube support device comprising:

an elongated longitudinally extending strip having a pair of opposing faces, wherein the strip having a length; and a plurality of tube engaging members extending from the pair of opposing faces, wherein the support device is sized such that the support device is located between adjacent rows of elongated tubes, wherein a portion of the plurality of tube engaging members extend from one face of the opposing faces and are arranged to contact the elongated tubes positioned adjacent the one face and another portion of the plurality of tube engaging members extend from another face of the opposing faces and are arranged to contact the elongated tubes positioned adjacent the other face, wherein the plurality of engaging members are located adjacent one end of the strip and extend along only a portion of the length of the strip.

11. The tube support device according to claim 10, wherein the plurality of engaging members are arranged in a plurality of transverse rows, wherein each transverse row contains at least one engaging member extending from the one face and at least one engaging member extending from the other face.

12. The tube support device according to claim 11, wherein the plurality of engaging members are formed as dimples in the strip.

13. The tube support device according to claim 11, wherein the plurality of engaging members are formed as corrugations in the strip.

14. The tube support device according to claim 13, wherein each corrugation extends in the longitudinal direction of the strip.

15. The tube support device according to claim 10, further comprising an engagement assembly on at least one end of the strip adapted to selectively engage with an orienting device such that the strip can be located between adjacent rows of elongated members and a fastening assembly to secure the tube support device to the plurality of elongated members.

16. The tube support device according to claim 10, wherein the support device is sized such that adjacent elongated tubes deflect away from each other.

17. A tube bundle device comprising:

a tube bundle having a plurality of elongated tubes, wherein the plurality of elongated tubes are arranged in rows; and at least one tube support device, wherein each tube support device comprising an elongated longitudinally extending strip having a pair of opposing faces, wherein the strip having a length, a plurality of tube engaging members extending from the pair of opposing faces, wherein the tube support device is sized such that the tube support device is located between adjacent rows of elongated tubes, wherein a portion of the plurality of tube engaging members extend from one face of the opposing faces and are arranged to contact the elongated tubes positioned adjacent the one face and another portion of the plurality of tube engaging members extend from another face of the opposing faces and are arranged to contact the elongated tubes positioned adjacent the other faces, wherein the plurality of engaging members are located adjacent one end of the strip and extend along only a portion of the length of the strip.

18. The tube bundle device according to claim 17, wherein the plurality of engaging members are arranged in a plurality of transverse rows, wherein each transverse row contains at least one engaging member extending from the one face and at least one engaging member extending from the other face.

19. The tube bundle device according to claim 17, wherein the plurality of engaging members are formed as dimples in the strip.

20. The tube bundle device according to claim 17, wherein the plurality of engaging members are formed as corrugations in the strip.

21. The tube bundle device according to claim 20, wherein each corrugation extends in the longitudinal direction of the strip.

22. The tube bundle device according to claim 17, further comprising an engagement assembly on at least one end of the strip adapted to selectively engage with an orienting device such that the strip can be located between adjacent rows of elongated members and a fastening assembly to secure the tube support device to the plurality of elongated members.

23. The tube bundle device according to claim 17, wherein the tube bundle device is a heat exchanger.

24. The tube bundle device according to claim 17, wherein the support device is sized such that adjacent tubes deflect away from each other.

* * * * *